US010684077B2

(12) United States Patent
Zanardi et al.

(10) Patent No.: US 10,684,077 B2
(45) Date of Patent: Jun. 16, 2020

(54) TUBE-NEST HEAT EXCHANGER WITH IMPROVED STRUCTURE

(71) Applicant: HEXSOL ITALY SRL, Bergamo (IT)

(72) Inventors: Luca Zanardi, Bergamo (IT); Fabiano Foglieni, Calusco d'Adda (IT)

(73) Assignee: HEXSOL ITALY SRL, Bergamo (IT)

( * ) Notice: Subject to any disclaimer, the term of this patent is extended or adjusted under 35 U.S.C. 154(b) by 0 days.

(21) Appl. No.: 15/568,847

(22) PCT Filed: Apr. 21, 2016

(86) PCT No.: PCT/IB2016/052259
§ 371 (c)(1),
(2) Date: Oct. 24, 2017

(87) PCT Pub. No.: WO2016/170487
PCT Pub. Date: Oct. 27, 2016

(65) Prior Publication Data

US 2018/0112925 A1 Apr. 26, 2018

(30) Foreign Application Priority Data

Apr. 24, 2015 (IT) ..... 102015000013010

(51) Int. Cl.
*F28F 7/00* (2006.01)
*F28D 7/16* (2006.01)
*F28F 9/02* (2006.01)

(52) U.S. Cl.
CPC ..... *F28D 7/1607* (2013.01); *F28F 9/028* (2013.01); *F28F 9/0263* (2013.01);
(Continued)

(58) Field of Classification Search
CPC ..... F28D 7/1607; F28F 9/028; F28F 9/0263; F28F 2255/02; F28F 2275/205
(Continued)

(56) References Cited

U.S. PATENT DOCUMENTS 828,807 A * 8/1906 Bolton ..... F28D 7/12 122/470
1,226,299 A * 5/1917 Boltz ..... F01P 3/18 165/292
(Continued)

FOREIGN PATENT DOCUMENTS

BE 436 780 12/1939
CN 201488612 5/2010
(Continued)

OTHER PUBLICATIONS

International Search Report dated Jul. 27, 2016 in International (PCT) Application No. PCT/IB2016/052259.
(Continued)

*Primary Examiner* — Claire E Rojohn, III
(74) *Attorney, Agent, or Firm* — Wenderoth, Lind & Ponack, L.L.P.

(57) ABSTRACT

A heat exchanger includes a pressurized shell and a tube bundle with exchanging tubes between flexible tubesheets. The flexible tubesheets are reciprocally interconnected by tie rods in a central zone of the flexible tubesheets which is devoid of exchanging tubes. The exchanging tubes in the tube bundle are arranged around the tie rods. The heat exchanger may further include conveying diaphragms arranged along the tube bundle. The conveying diaphragms may be shaped, alternately, as discs and rings.

20 Claims, 4 Drawing Sheets

(52) U.S. Cl.
CPC ..... *F28F 2255/02* (2013.01); *F28F 2265/26* (2013.01); *F28F 2275/205* (2013.01)

(58) Field of Classification Search
USPC ..... 165/83
See application file for complete search history.

(56) References Cited

U.S. PATENT DOCUMENTS 1,454,053 A * 5/1923 Jones ..... F28F 9/22 165/161
1,517,673 A * 12/1924 Eberle ..... F16N 39/02 184/104.3
1,771,160 A * 7/1930 Chapman ..... F28F 21/04 165/165
1,798,354 A * 3/1931 Ris ..... F28F 9/22 165/159
2,049,748 A * 8/1936 Rathbun ..... F28D 7/1646 165/146
2,062,321 A * 12/1936 Levin ..... F25J 3/08 165/140
2,411,097 A * 11/1946 Kopp ..... F28F 9/22 165/158
2,519,084 A * 8/1950 Tull ..... F28D 7/08 165/158
2,625,138 A * 1/1953 Jacoby ..... F24H 1/205 122/14.22
2,655,350 A * 10/1953 Gaylord, Jr. ..... F28F 21/02 165/160
2,995,341 A * 8/1961 Danesi ..... F22D 1/32 165/110
3,209,819 A * 10/1965 Leclercq ..... F28D 7/103 165/155
3,247,897 A * 4/1966 Ammon ..... F28D 7/005 165/81
3,254,709 A * 6/1966 Lyall ..... F28D 7/06 165/158
3,254,967 A * 6/1966 Wentworth ..... C07C 29/152 422/148
3,265,128 A * 8/1966 Legrand ..... F28F 9/22 165/159
3,280,904 A * 10/1966 Hings ..... F28F 21/02 165/143
3,285,713 A * 11/1966 Goehre ..... B01J 19/2425 422/658
3,380,516 A * 4/1968 Kaye ..... F24H 1/145 165/81
3,587,732 A * 6/1971 Burne ..... F28D 7/1669 165/158
3,666,423 A * 5/1972 Muenger ..... B01J 8/025 422/200
4,105,067 A * 8/1978 Bovagne ..... F16L 3/22 165/159
4,127,389 A * 11/1978 Hackemesser ..... C01B 3/384 422/201
4,299,273 A * 11/1981 Fischli ..... F28D 7/005 165/162
4,357,991 A * 11/1982 Cameron ..... F28D 7/1669 165/159
4,538,678 A * 9/1985 Fukumoto ..... F28D 7/024 165/162
4,724,754 A * 2/1988 Crozat ..... A23G 3/0215 165/145
4,811,783 A * 3/1989 Linzer ..... F22B 1/025 122/DIG. 13
4,919,844 A * 4/1990 Wang ..... C01B 3/382 252/373
5,044,431 A * 9/1991 Cameron ..... F28F 9/22 165/158
5,101,892 A * 4/1992 Takeuchi ..... F28F 9/182 165/158
5,161,605 A * 11/1992 Gutlhuber ..... B01J 8/067 165/103
5,277,247 A * 1/1994 Cameron ..... B01D 1/06 165/159
5,291,944 A * 3/1994 Sanz ..... F28D 7/1669 165/157
5,638,898 A * 6/1997 Gu ..... F28F 1/08 165/160
5,653,282 A * 8/1997 Hackemesser ..... F22B 1/1869 165/134.1
5,759,500 A * 6/1998 Garner ..... B01D 53/8631 422/201
5,915,472 A * 6/1999 Takikawa ..... F28D 7/1607 165/158
6,105,664 A * 8/2000 Gillbrand ..... F01M 1/10 165/119
6,167,951 B1 * 1/2001 Couch ..... C02F 1/02 165/159
6,209,624 B1 * 4/2001 Cameron ..... F24H 3/087 126/101
6,513,583 B1 * 2/2003 Hughes ..... F28D 7/1607 165/159
6,536,513 B1 * 3/2003 Font-Freide ..... B01J 19/0013 165/159
6,855,272 B2 * 2/2005 Burlingame ..... B01J 8/008 252/373
6,988,540 B2 * 1/2006 Jensen ..... F28D 7/1669 165/134.1
7,698,995 B2 * 4/2010 Demmel ..... A23G 3/04 366/132
8,091,514 B2 * 1/2012 Jimenez ..... F23J 15/06 122/20 B
9,101,899 B2 * 8/2015 Singh ..... B01J 8/0484
9,273,913 B2 * 3/2016 Steinbauer ..... F28D 7/024
9,382,114 B2 * 7/2016 Yun ..... C01B 3/384
9,644,902 B2 * 5/2017 Pazzaglia ..... F28D 7/16
9,677,827 B2 * 6/2017 Garcia GonzaLez ..... F28F 9/0241
9,885,523 B2 * 2/2018 Zimmer ..... F28D 9/0006
2001/0017202 A1 * 8/2001 Mitsumoto ..... B01J 19/002 165/174
2003/0111210 A1 * 6/2003 Tsujita ..... F28F 1/426 165/51
2003/0116306 A1 * 6/2003 Besik ..... F28D 7/1607 165/109.1
2004/0081268 A1 * 4/2004 Klarner ..... F28D 7/1607 376/405
2004/0238161 A1 * 12/2004 Al-Anizi ..... F28D 7/1607 165/134.1
2006/0029539 A1 * 2/2006 Dutta ..... B01J 8/009 423/651
2006/0289153 A1 * 12/2006 Mulder ..... F28D 7/1607 165/160
2008/0038165 A1 * 2/2008 Burlingame ..... F28D 7/16 422/608
2011/0030935 A1 * 2/2011 Riondet ..... F28F 9/0209 165/173
2012/0247727 A1 * 10/2012 Wepfer ..... F22B 37/205 165/69
2013/0075064 A1 * 3/2013 Fetcu ..... F28D 15/0275 165/104.21
2013/0105127 A1 * 5/2013 Postma ..... F28D 1/053 165/157
2014/0262174 A1 * 9/2014 Wunning ..... F28F 1/006 165/158
2014/0305620 A1 * 10/2014 Heinio ..... F28F 9/00 165/166
2014/0318748 A1 * 10/2014 Svensson ..... C09D 5/1675 165/133
2014/0363350 A1 * 12/2014 Hodson ..... F28F 1/00 422/187
2015/0207378 A1 * 7/2015 Buttner ..... H02K 5/20 310/54
2018/0112925 A1 * 4/2018 Zanardi ..... F28F 9/028
2019/0360756 A1 * 11/2019 Frechette ..... F28D 7/1607

(56) References Cited

U.S. PATENT DOCUMENTS

FOREIGN PATENT DOCUMENTS

| | | |
|---|---|---|
| CN | 204829849 | 12/2015 |
| DE | 86 01 340 | 5/1987 |
| DE | 196 39 422 | 9/1997 |
| DE | 202 19 277 | 2/2003 |
| EP | 0 053 248 | 6/1982 |
| EP | 1 009 783 | 7/2004 |
| FR | 2 518 730 | 6/1983 |
| GB | 1 444 847 | 8/1974 |
| WO | 2011/063624 | 6/2011 |

OTHER PUBLICATIONS

Third Party Observation submitted Aug. 21, 2017 in International (PCT) Application No. PCT/IB2016/052259.

* cited by examiner

TUBE-NEST HEAT EXCHANGER WITH IMPROVED STRUCTURE

BACKGROUND OF THE INVENTION

1. Field of the Invention

The present invention refers to a heat exchanger of the type with a pressurized shell and a tube bundle between inlet and outlet tubesheets. In particular, the exchanger is of the kind with at least one tubesheet, of the 'thin' kind, i.e. with the tubesheet designed to be relatively flexible and to withstand the internal pressure of the exchanger. In still greater detail, the exchanger is a TLE (Transfer Line Exchanger) used in the ethylene production cycle.

2. Description of the Related Art

In commonly known techniques, there are many types of heat exchangers for the most disparate uses.

For example, DE19639422 describes an air/water heat exchanger for large diesel engines. DE8601340 describes an air dryer, which obviously does not work under pressure, and has solely simple gaskets sealing the ends of the tubes through which the fluid flows.

Existing tube bundle exchangers available on the ethylene market are essentially divided into two large categories: those with flexible tubesheets and those with reinforced tubesheets.

The former promote deflection of the tubesheets as a result of the internal pressure between the tubesheets and thus mitigate secondary stresses acting on the tubes (due to elongation of the tubes as a result of thermal expansion) but they work with higher primary stresses acting on the tubesheet (the strains being proportional to the deformations resulting from elastic reactions) and with tubes working under traction. The latter work with low primary stresses (with tubesheets always remaining flat) but the tubes are physiologically subjected to working in compression, with potential risks of buckling and Euler instability.

The thin tubesheet exchangers are therefore preferable for some aspects.

It is true that the TLEs with flexible tubesheets are, however, subject to a potential risk in the event of corrosion of the coupling region between the tubes and tubesheet and/or in correspondence with holes in the diaphragms; in fact the rupture of a tube in the bundle results in the axial thrust from such tube being suddenly spread over the neighboring tubes, with an increase in the stress acting thereupon and a potential chain reaction consisting of the tubes breaking, with the sudden collapse of the entire exchanger.

Furthermore, the tube bundle exchangers, especially the TLE kind for ethylene, suffer from a considerable erosion problem caused by the gas in the inlet tubesheet ("hot" tubesheet) as a result of the particulate (coke) being dragged by the high speed gases (>100 m/s).

Because of the conical diffuser which connects the gas arrival point with the tubesheet and which facilitates the entry in the central part of the bundle and penalizes the peripheral tubes, there is also localized erosion primarily in the center of the tubesheet, where strains can be greater.

The potential poor distribution of the hot flue gases in the tubes, due to the conical diffuser facilitating entry in the central part of the bundle and penalizing the peripheral tubes, can lead to localized overheating and excessive thermal stresses on the tubesheet and on the tube/tubesheet joints.

There is, in fact, a possibility of high corrosion on the 'hot' inlet tubesheet on the shell side due to areas of flow which are either dead or stagnant in the lowest points of the natural circulation circuit (thermosiphon) and which are not properly cooled.

Finally, in the (classic) configuration of a TLE with the ascending vertical flue gas motion, a concentration of vapor bubbles can also be generated in the upper part of the TLE behind the outlet tubesheet ("cold" tubesheet) with potential stagnation/blanketing which triggers overheating and/or high levels of accrued deposition of corrosive substances on the terminal part of the tubes in contract with the tubesheet.

Fluid dynamic instability can also be generated during the two-phase descending vertical motion which carries the mixture of coolant (generally, water and vapor) to the outlet pipe or pipes, due to the continuous variation of the working point and potential scenarios with low Froude numbers in the liquid phase, which trigger a countercurrent motion between the liquid phase and the vapor phase rather than a concurrent motion of the two phases in the descending duct.

To endeavor to improve the situation, various solutions have been proposed within the commonly known technique to endeavor to render water distribution uniform in the lowest point of the circuit (still with reference to a TLE with ascending vertical flue gas motion).

For example, it has been proposed that a side-to-side flow scrubbing action be performed on the tubesheet by means of a suitably shaped diaphragm appropriately spaced from the tubesheet.

However, such solution produces a unidirectional high speed, but also stagnation in the direction perpendicular to the flow and in the shaded areas of the tubes.

In addition, the unidirectional high speed causes a high loss of concentrated load and therefore a decrease in the radiator's recirculation ratio.

Furthermore, there is an increased possibility of stratification of the corrosive water deposits on the upper face of the diaphragm in correspondence with the through holes for the fluid.

It has also been proposed that water channeling be provided by means of ducts or tunnels, but such arrangement renders it necessary to ensure that water be drawn upwards in each tunnel in order to wet the surface of the tubes within a rigid tubesheet anchored to the flexible tubesheet. There is, therefore, a reduction in the flow rate at the end of the tunnel, a reduction for which it has been attempted to compensate by shaping the ducts with a section which grows gradually smaller so as to compensate for this effect and maintain high speeds which prevent scaling and deposits. Nevertheless, the high speeds result in a further high loss of concentrated load and therefore a decrease in the radiator's recirculation ratio.

It has also been proposed that there be water inlets in rings which are concentric to the flue gas tubes, but such arrangement leads to high losses of the inlet load within the ring, because the equivalent diameter of the annular geometry is small. Therefore, there is a greater possibility of clogging due to dragged deposits, resulting in local overheating of the tube wall in correspondence with the inlet. In addition, there are high speeds due to the reduced section of the passageway of the rings, which means a high loss of concentrated load and therefore a decrease in the radiator's recirculation ratio.

FR2518730 describes an example of a simple heat exchanger with thick tubesheets.

US2008/038165 is an example of an exchanger for ammonia synthesis with a single thick tubesheet at one end of the bundle and no tubesheet at the other end.

BE436780 describes a water/oil exchanger with exchanging tubes arranged between the tubesheets, which also fill the central zone of the exchanger. Three tie rods are arranged around the periphery of the exchanging tube bundle in order to support diaphragms within the exchanger.

SUMMARY OF THE INVENTION

The main aim of the present invention is to provide an exchanger with a tube bundle and flexible tubesheet which overcomes the drawbacks of the commonly known technique, with a simple and efficient structure and greater operating safety.

In view of this aim, the decision was made to produce, according to the invention, a heat exchanger with a pressurized shell and a tube bundle with exchanging tubes between flexible tubesheets, characterized by the fact that the flexible tubesheets are reciprocally interconnected by tie rods in a central zone of the tubesheets which is devoid of exchanging tubes and the exchanging tubes in the tube bundle are arranged around such tie rods.

According to a further aspect of the invention, the heat exchanger is characterized by the fact that transverse diaphragms are arranged along the tube bundle for conveying the exchanging fluid, alternating in shape between discs and rings along the axis of the bundle and, preferably, the diaphragm closest to a tubesheet is ring-shaped. Advantageously, the ring-shaped diaphragms have a central passageway which is crossed solely by tie rods.

BRIEF DESCRIPTION OF THE DRAWINGS

To provide a clearer explanation of the innovative principles of the present invention and the advantages thereof with respect to the commonly known technique, an exemplifying embodiment in which the principles are applied will be described below, with the help of the accompanying drawings. In the drawings.

DETAILED DESCRIPTION OF THE INVENTION

Figure 1:
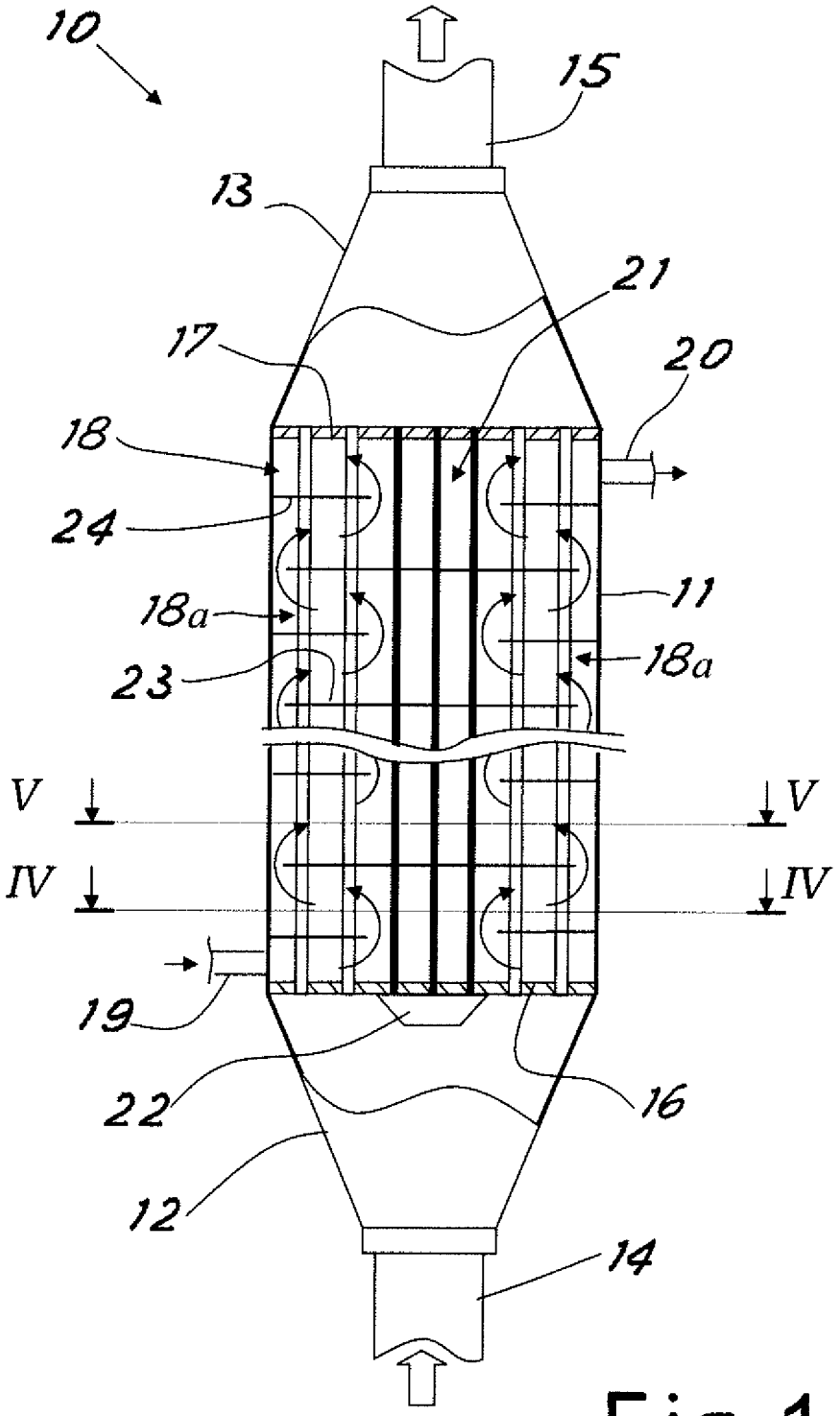
FIG. 1 is a schematic, partially sectioned, side view of an exchanger according to the invention.

With reference to the figures, FIG. 1 shows an exchanger as a whole denoted by 10, produced according to principles of the present invention.

The exchanger 10 comprises a pressurized shell 11, at the opposite ends of which there are conical diffusers or manifolds 12, 13, to which pipes 14, 15 are fitted for the inlet and outlet of the fluid to be cooled (for example, ethylene steam). A tube bundle 18 is arranged in the shell between the tubesheets 16 and 17 in order to be immersed in the exchanging fluid (e.g. water) which circulates in the exchanger via inlet and outlet pipes 19 and 20. The tubesheets are of the kind known as "thin" and are, therefore, flexible tubesheets, which means that the capacity to withstand flexion due to the internal pressure of the exchanger is ensured by the tube bundle welded between the tubesheets, and the tubesheets flex outwards also due to the thermal expansion of the bundle.

According to the principles of the invention, the tube bundle advantageously comprises a central zone devoid of tubes and in such area the tubesheets are reciprocally interconnected by tie rods 21. The tubes, denoted as a whole with 18*a* and intended to be flowed through by the fluid to be cooled, are arranged around the central zone with the tie rods 21. As can be seen in the figures, the central zone—devoid of tubes but equipped with tie rods—comprises the center of the tubesheets.

Essentially, the core of the bundle is composed solely of tie rods which do not take part in the circulation of the fluid to be cooled and the tubes are arranged in a torus around the tie rods.

Advantageously, the area with solely tie rods can be, approximately, in correspondence with the section of the inlet pipe 14. The tie rods can be filled with solid metal elements or tubes similar to the tubes in the bundle but sealed at the ends. Generally, the inertia and section surface area thereof will be comparable to that of the exchanging tubes.

Figure 2:
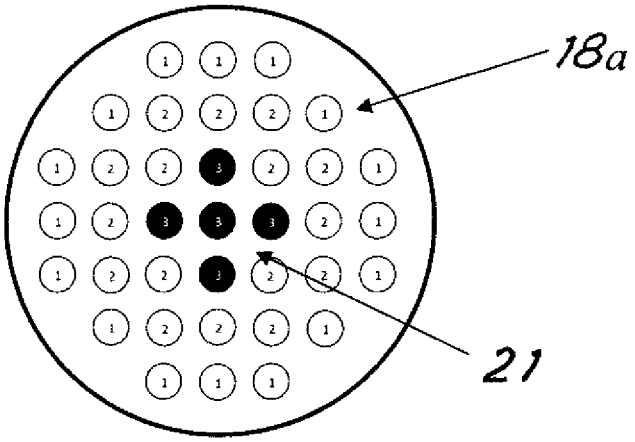
FIG. 2 shows a schematic, cross-sectioned view of a first possible arrangement of the tube bundle in the exchanger shown in FIG. 1.

FIG. 2 shows, by way of example, a possible arrangement of the bundle, showing the central tie rods (advantageously arranged in a crosswise fashion) and the tubes surrounding such tie rods.

The tie rods between the tubesheets help to withstand the pressure thrust between the tubesheets. In other words, the tie rods can transfer the pressure thrust acting on the tubesheets from one tubesheet to the other.

The innovative structure of the exchanger which features flexible tubesheets with the presence of tie rods in the central part of the bundle and exchanging tubes solely around the tie rods provides various advantages.

First and foremost, the tie rods are immersed in the cooling fluid just like the tubes but, since such rods are not flowed through by the hot fluid, they have the same temperature as the cooling fluid (for example, in an exchanger for ethylene with exchanging water, such rods can be—for example—approximately 10° C. colder than the exchanging tubes surrounding them).

The arrangement is therefore advantageous because the buckling of the flexible tubesheets due to the pressure is mitigated in the central part by the different temperature profiles of the tubes and tie rods. Since the stresses are proportional to the deformations, the central part of the flexible tubesheets is less stressed than in the commonly known design solutions.

At the same time, the tubes are also less stressed by an axial load, because the further away one moves from the center, proceeding outwards in a radial fashion, the more the axial stress decreases and the more the flexural stress increases due to the flexion (buckling due to pressure) of the tubesheet.

Thanks to the decrease in the axial forces on the tubes and the improved diversion of the flow towards the peripheral tubes, the gas distribution in the tubes can be optimized.

In fact, the gas flow is diverted to the tubes surrounding the tie rods and a more uniform distribution of the gas can be obtained in all the exchange tubes, in addition to a minimization of the formation of vortices and a reduced time of stay in the distribution cone for the flue gas (i.e. better yield from the rapid flue gas cooling reactions).

Figure 3:
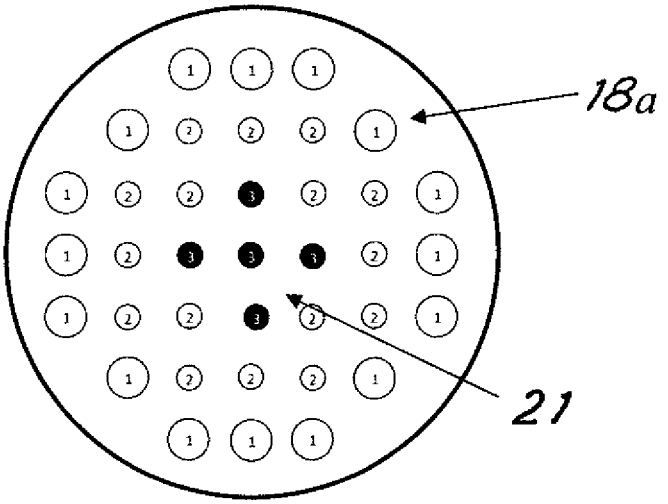
FIG. 3 shows a schematic, cross-sectioned view of a second possible arrangement of the tube bundle in the exchanger shown in FIG. 1.

The improved distribution of axial forces within the bundle also means that the wall of the outermost peripheral tubes (where the flexural stress component is greater than the axial stress) can be thinner, thereby increasing the internal aperture of the passageway. Alternatively, it is also possible to increase the diameter of the outer tubes as shown, by way of example, in FIG. 3.

In any case, an increased passageway aperture at the periphery of the bundle results in the gas particles—which have to travel freely along a route which is, on average, longer in order to reach the peripheral tubes—having nevertheless the advantage of being exposed to a greater surface area and therefore lower losses of pressure.

Incidentally, the thicker tubes in the inner part have a greater margin against potential catastrophic ruptures in the event of thinning due to corrosion (even though, with the solution described here, corrosion is either reduced or eliminated).

Returning to FIG. 1, an insert 22 can also be featured, arranged in correspondence with the tie rods on the inlet tubesheet 16 on the hot side, in order to reduce the volume in the inlet conical diffuser.

This allows the time of stay of the fluid in the conical diffuser to be reduced and improved protection of the hot tubesheet to be offered. Furthermore, diversion is the fluid towards the inlets of the tubes in the bundle is further improved.

The insert 22, with a form which is generally tapered in the incoming flow direction, can be easily optimized by means of a computational fluid dynamics system, in order to better match the conformation of the conical diffuser. The insert can be made in one piece with the tubesheet or fitted thereonto in various ways, for example by keying. A removable fitting can be advantageous in order to be able to replace the insert when, possibly, worn, thereby constituting a sacrificial tubesheet for the protection of the thin tubesheet therebehind.

As can be seen, again in FIG. 1, diaphragms can also be used in the exchanger according to the invention, arranged transversely along the bundle, to convey the exchanging fluid.

Advantageously, such diaphragms have the form of discs 23 and rings 24, which alternate along the axis of the bundle in order to ensure circulation as shown by the arrows in FIG. 1, in other words, winding between a peripheral passageway and a central passageway. The exchanger (in particular a TLE) is, in fact, preferably vertical, with an ascending motion of the fluid (flue gases) to be cooled.

As seen in FIG. 1, the first and the last diaphragm have, advantageously, a ring conformation. This is possible due to the fact that, in the central passageway of the ring-shaped diaphragm, where the flow of cooling fluid passes, solely the tie rods are, advantageously, present. In fact, in general, the central part of the tubesheet is exposed to a speed of approximately zero and therefore there is always a risk, in such central zone, of the accumulation of debris/deposits with consequent overheating locally, since the deposits and fouling in general are an additional thermal resistance which prevents removal of the heat from the tubesheet by the cooling fluid.

If, according to the commonly known technique, there were no exchange tubes in such central zone, the use of ring-shaped diaphragms in proximity to the tubesheets would be impossible because such arrangement would involve an unacceptable increase in the tubesheet temperature due to the deposits, which would not allow correct removal of the heat conveyed into such zone by the exchange tubes.

With the principles of the present invention, a possible accumulation of deposits in the central zone of the tubesheet does not, however, result in a rise in temperature locally because the central part of the bundle is not fed with hot fluid.

Figure 4:
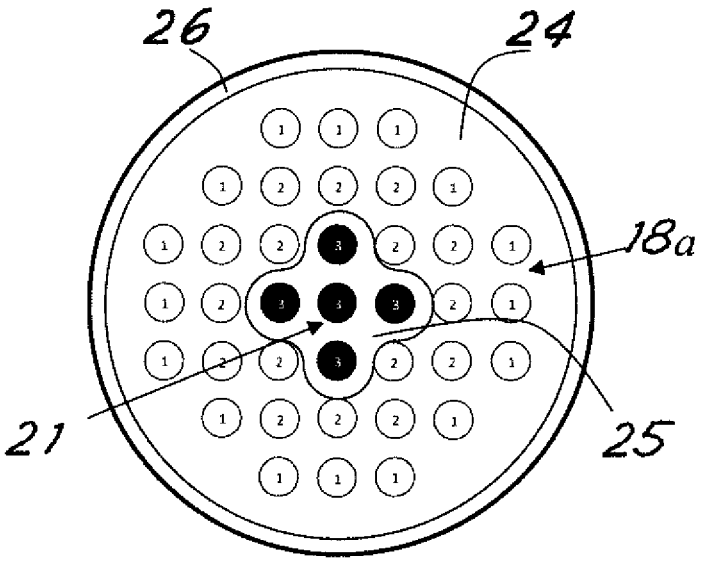
FIG. 4 shows a schematic, cross-sectioned view according to line IV-IV in FIG. 1.

In FIG. 4, there is a section of the exchanger shown which shows an advantageous embodiment of one of the ring-shaped diaphragms 24, with the central hole 25 whose perimeter follows the contour of the bundle of tie rods 21 (for example, advantageously arranged in a cross fashion) so that the solid crown part of the baffle is traversed by the exchange tubes and, preferably, supported thereby. The baffle may also have a minimum space between the peripheral edge thereof and the inner wall of the exchanger 26.

Figure 5:
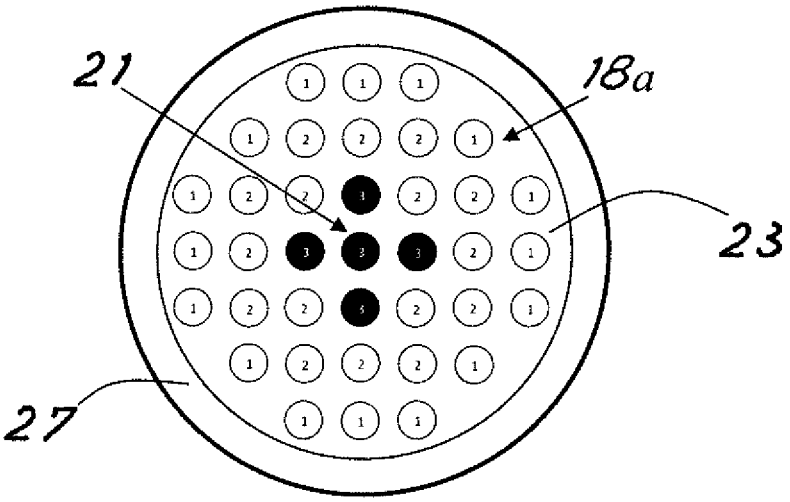
FIG. 5 shows a schematic, cross-sectioned view according to line V-V in FIG. 1.

In FIG. 5, however, there is a section of the exchanger shown which shows an advantageous embodiment of one of the disc-shaped diaphragms 23, with ample peripheral space 27 for circulation of the exchanging fluid between the two sides of the disc fluid.

Advantageously, the possibility of using ring-shaped diaphragms in proximity to the internal faces of the tubesheets also allows improved inlet and outlet circulation of the cooling fluid.

Figure 6:
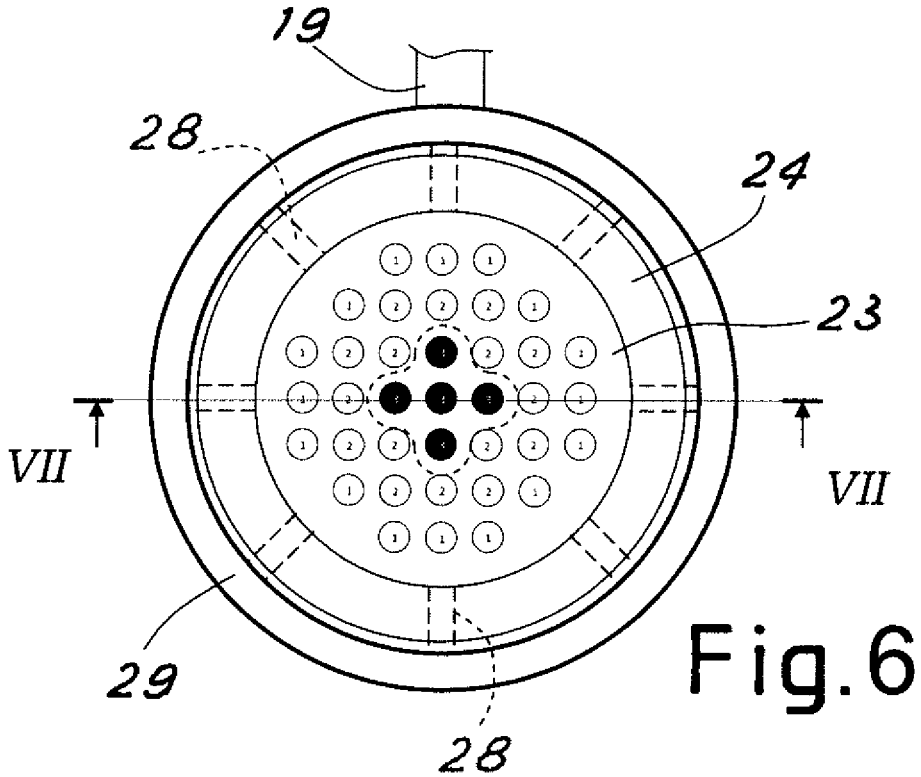
FIG. 6 shows a schematic, cross-sectioned view (according—generally—to line V-V in FIG. 1) of a possible embodiment of areas, in proximity to the tubesheets, for the inlet and outlet of the coolant within an exchanger according to the invention.
Figure 7:
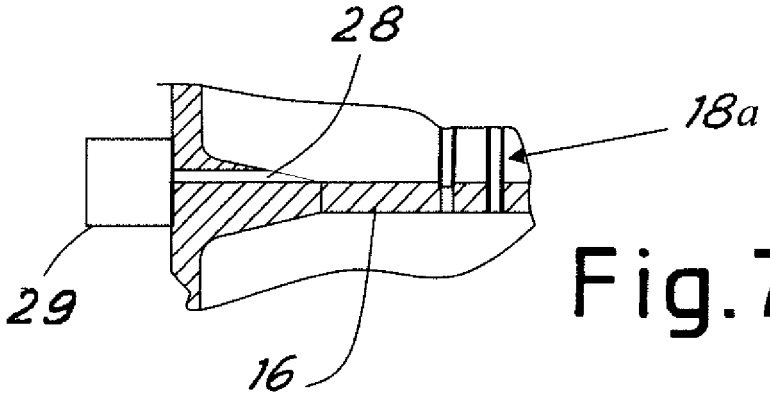
FIG. 7 shows a partial schematic view of a section according to line VII-VII in FIG. 6.

As shown in the embodiment in FIGS. 6 and 7, radial channels 28 can be advantageously featured on the edge of the tubesheet within the exchange chamber. The channels 28 are connected to the respective inlet pipes 19 through a connection pipe, for example, in the form of a torus 29 around the periphery of the exchanger. Advantageously, such channels are a plurality and are distributed evenly around the circumference of the tubesheet.

The radial channels 28 face the interior of the exchanger in order to take in the flow of cooling fluid between the tubesheet and the facing ring-shaped baffle.

Advantageously, the opposite end of the exchange chamber can also feature a similar structure of radial channels 28 for the outlet of exchanging fluid in proximity to the opposite tubesheet 17.

The possibility of having multiple water inlets and at least one exchanging fluid outlet (which, at the outlet, can be a mixture of water plus steam), which is completely radial and allows a more uniform distribution of the fluid and overcomes various problems encountered with the commonly known systems.

For example, with reference to a standard vertical TLE with ascending hot flue gases, the solution described above prevents a descending vertical two-phase flow, which would be unstable and/or pulsatile for certain operating points/surface speeds of the liquid and vapor phases.

The described adduction and extraction arrangement for the exchanging fluid also allows a circular fluid flow symmetry and a configuration known as a 'No Tubes In The Window' configuration, in which all the heat exchange tubes have the same Euler's critical load, regardless of the radial position thereof within the bundle.

Moreover, by placing the outlet pipe of water/steam mixture flush with the upper tubesheet, the 'downflow' area is eliminated. By creating a torus, with multiple access points, which collects the steam coming from all radial directions, pockets of steam are prevented from forming on the top of the exchanger.

Figure 8:
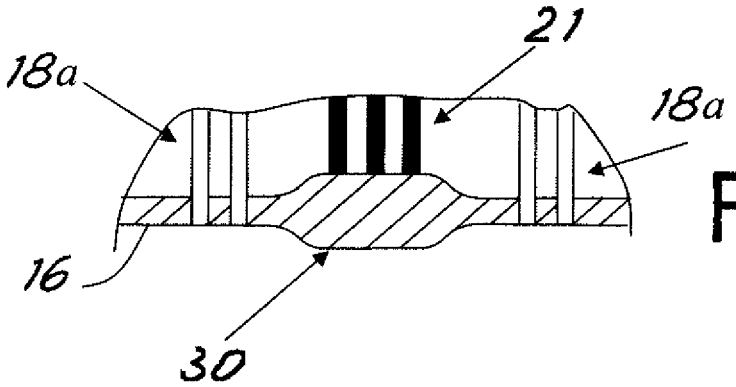
FIG. 8 shows a schematic, partial, sectioned view of a possible variant of a central zone of the tubesheet in an exchanger according to the invention.

FIG. 8 shows a further advantageous embodiment, according to which the tubesheet has a local thickening 30 in the central part, in correspondence with the tie rods 21, which can be used as a corrosion/erosion allowance. This thickening is always possible thanks to the fact that, with the structure according to the invention, the central part of the tubesheet is always at approximately the same temperature as the exchanging fluid. The thickening can also implement or comprise the external flow diversion insert.

At this point, it is clear how the intended aims are achieved. A tube bundle exchanger with flexible tubesheets produced according to the invention is prone to much fewer erosion and corrosion effects and also allows greater efficiency and flexibility of use. Also, it should be noted that, thanks to the principles of the invention, it is also possible to produce an exchanger which is symmetrical with respect to the transverse plane, i.e., which can be overturned, for example, to extend the working life thereof.

Naturally, the description set out above of an embodiment applying the innovative principles of the present invention is given by way of example of such innovative principles and therefore must not be deemed a limitation of the patent right claimed here. For example, the proportions of the various parts of the exchanger may vary with respect to that shown in the drawings in order to adapt to specific requirements, as is easily imaginable by persons skilled in the art. Also the number of tubes, tie rods and any disc or ring-shaped internal diaphragms may vary depending on the embodiment and the specific requirements.

Finally, there may be various techniques for fastening the tube bundle to the tubesheets, as is easily imaginable by persons skilled in the art. For example it may be advantageous to use Internal Bore Welding welds (IBW), as are known by persons skilled in the art and as shown schematically in FIG. 7, for the tube on the left.

The invention claimed is:

1. A heat exchanger comprising:

a pressurized shell; and a tube bundle with exchanging tubes between flexible tubesheets, wherein the flexible tubesheets are reciprocally interconnected by a plurality of tie rods in a central zone of the flexible tubesheets which is devoid of exchanging tubes, and the exchanging tubes in the tube bundle are arranged around the plurality of tie rods, the plurality of tie rods being centrally positioned within the pressurized shell with the exchanging tubes surrounding all of the plurality of tie rods, and wherein each of the plurality of tie rods is a tube which: (i) has a structure corresponding to a structure of each of the exchanging tubes; and (ii) is sealed at both ends thereof.

2. The heat exchanger according to claim 1, wherein each of the exchanging tubes at a periphery of the tube bundle has a wall thickness which is less than a wall thickness of each of a remainder of the exchanging tubes in the tube bundle.

3. The heat exchanger according to claim 1, wherein each of the exchanging tubes at a periphery of the tube bundle has a diameter which is greater than a diameter of each of a remainder of the exchanging tubes in the tube bundle.

4. The heat exchanger according to claim 1, further comprising transverse diaphragms arranged along the tube bundle for conveying an exchanging fluid, wherein the transverse diaphragms alternate in shape between discs and rings along an axis of the tube bundle.

5. The heat exchanger according to claim 4, wherein one of the transverse diaphragms closest to one of the flexible tubesheets is ring-shaped.

6. The heat exchanger according to claim 4, wherein each of the transverse diaphragms shaped as rings has a central passageway which is crossed by the plurality of tie rods and is not crossed by the exchanging tubes.

7. The heat exchanger according to claim 1, wherein at least an inlet tubesheet of the flexible tubesheets has an insert protruding from a hot side of the inlet tubesheet in the central zone of the flexible tubesheets, in correspondence with the plurality of tie rods.

8. The heat exchanger according to claim 1, wherein at least an inlet tubesheet of the flexible tubesheets has a greater thickness in the central zone of the flexible tubesheets featuring interconnection with the plurality of tie rods than in a peripheral part of the inlet tubesheet.

9. A heat exchanger comprising:

a pressurized shell;

a tube bundle with exchanging tubes between flexible tubesheets; and radial channels for intake of an exchanging fluid or outlet of the exchanging fluid, wherein the flexible tubesheets are reciprocally interconnected by a plurality of tie rods in a central zone of the flexible tubesheets which is devoid of exchanging tubes, and the exchanging tubes in the tube bundle are arranged around the plurality of tie rods.

10. The heat exchanger according to claim 1, further comprising radial channels for intake of an exchanging fluid or outlet of the exchanging fluid.

11. The heat exchanger according to claim 9, wherein the radial channels are circumferentially evenly spaced.

12. The heat exchanger according to claim 9, wherein the radial channels are surrounded by and connected to a toroidal pipe for the intake of the exchanging fluid.

13. The heat exchanger according to claim 9, wherein the radial channels are adjacent to at least an inlet tubesheet of the flexible tubesheets.

14. The heat exchanger according to claim 10, wherein the radial channels are circumferentially evenly spaced.

15. The heat exchanger according to claim 10, wherein the radial channels are surrounded by and connected to a toroidal pipe for the outlet of the exchanging fluid.

16. The heat exchanger according to claim 10, wherein the radial channels are adjacent to at least an outlet tubesheet of the flexible tubesheets.

17. The heat exchanger according to claim 1, wherein:

the tube bundle extends in an axial direction between a terminal upstream end and a terminal downstream end such that the tube bundle begins at the terminal upstream end and ends at the terminal downstream end; and the flexible tubesheets include a first flexible tubesheet at the terminal upstream end of the tube bundle and a second flexible tubesheet at the terminal downstream end of the tube bundle.

18. The heat exchanger according to claim 1, wherein at least one of:

an inertia of each of the plurality of tie rods corresponds to an inertia of each of the exchanging tubes; and a section surface area of each of the plurality of tie rods corresponds to a section surface area of each of the exchanging tubes.

19. A heat exchanger comprising:

a pressurized shell; and a tube bundle with exchanging tubes between flexible tubesheets, wherein the flexible tubesheets are reciprocally interconnected by a plurality of tie rods in a central zone of the flexible tubesheets which is devoid of exchanging tubes, and the exchanging tubes in the tube bundle are arranged around the plurality of tie rods, the plurality of tie rods being centrally positioned within the pressurized shell with the exchanging tubes surrounding all of the plurality of tie rods, and wherein each of the plurality of tie rods is filled with solid metal elements.

20. The heat exchanger according to claim 19, wherein at least one of:

an inertia of each of the plurality of tie rods corresponds to an inertia of each of the exchanging tubes; and a section surface area of each of the plurality of tie rods corresponds to a section surface area of each of the exchanging tubes.

* * * * *